United States Patent [19]

Brown

[11] Patent Number: 4,973,010

[45] Date of Patent: Nov. 27, 1990

[54] CARPET ROLLING MACHINE

[75] Inventor: Robert W. Brown, Anoka, Minn.

[73] Assignee: Production Design Products, Inc., Anoka, Minn.

[21] Appl. No.: 317,424

[22] Filed: Mar. 1, 1989

[51] Int. Cl.[5] ..... B65H 18/08

[52] U.S. Cl. ..... 242/67.2; 242/67.1 R; 242/DIG. 3

[58] Field of Search ..... 242/67.1 R, 67.2, 55, 242/55.1, DIG. 3; 72/146

[56] References Cited

U.S. PATENT DOCUMENTS

| | | | |
|---|---|---|---|
| 3,474,980 | 10/1969 | Mann, Jr. | 242/67.1 R |
| 4,298,173 | 11/1981 | Johansson | 242/55 X |
| 4,542,859 | 9/1985 | Gerstenberger | 242/67.2 |
| 4,573,644 | 3/1986 | Brown | 242/67.1 X |
| 4,765,554 | 8/1988 | Tuffal et al. | 242/67.1 R |
| 4,830,304 | 5/1989 | Fuke et al. | 242/67.2 |

*Primary Examiner*—Daniel P. Stodola
*Assistant Examiner*—Paul Thomas Bowen
*Attorney, Agent, or Firm*—Burd, Bartz & Gutenkauf

[57] ABSTRACT

A machine for quickly and efficiently rolling carpet runners or mats after laundering, for storage, transport and reuse. The machine includes a set of belts (23) for upwardly inclined travel and an interesting set of belts (26) for generally vertical traveling. An assembly of arcuate fingers (28) cooperates with the belts to guide the leading edge of a carpet runner (27) into the beginning of a roll so as to assist in formation of a tight compact roll of carpet. An electric motor (20) is provided for driving the belts (23,26). Upon completion of the carpet roll, air cylinder (34) and crank arm (36) are provided for retracting the finger assembly to permit the carpet roll to roll down the inclined belts (23) for removal from the machine. Stop arms (37) are provided to retain the rolled carpet. Control switches actuated by foot pedal (44) and buttons (54 and 55 ) are provided for the belt drives, finger assembly, raising and lowering and extension and retraction of the stop arms (37). Box (52) for collecting dislodged grit is provided.

18 Claims, 6 Drawing Sheets

CARPET ROLLING MACHINE

BACKGROUND OF THE INVENTION

1. Field of the Invention

This invention is directed to a machine for rolling up relatively short lengths of carpet used as temporary runners. In many public buildings, during wet weather, carpet runners or mats are laid on the floor immediately inside of entrances to absorb most of the water and pick up most of the dirt carried in from the outside. This prevents the water and dirt from being carried throughout the building, into elevators, etc., and greatly facilitates the maintenance of building lobbies, hallways, and the like. These carpet runners quickly become soiled and are then laundered and rolled for use when next needed. The present invention is directed to a machine for facilitating rolling up carpet runners after laundering, particularly narrow runners of about 2 to 4 feet in width, the size in most common use.

2. The Prior Art

My prior U.S. Pat. No. 4,573,644 discloses a basic machine for rolling carpet runners or mats after laundering. That machine, adapted for rolling carpet lengths up to about 6 feet in width, is characterized by at least a pair of spaced apart parallel rollers supporting a series of endless parallel spaced apart belts for movement in a horizontal plane to carry the carpet to be rolled to a further series of a plurality of endless parallel spaced apart belts supported for movement in a generally vertical plane and alternating with the horizontally supported belts.

The machine of my prior patent is further characterized by at least one concave forwardly facing arcuate guide plate supported at the juncture between the two series of belts to direct the leading edge of a horizontally moving carpet runner vertically into engagement with the vertically movable belts.

The present invention is directed to an improved carpet rolling machine of the type of my earlier patent, especially adapted to the rolling of narrower widths of carpet runners, which, among other features, eliminates the need for the arcuate guide plate.

SUMMARY OF THE INVENTION

Broadly stated, the machine for rolling carpet runners according to the present invention includes a frame supporting a set of at least a pair of spaced apart parallel rollers for rotation in an upwardly inclined plane, one of the rollers being connected to a drive means. A first series of carpet carrying belts are supported by the first set of rollers for longitudinal upwardly sloped travel from front to rear in response to rotation of the rollers. These belts are parallel and spaced apart. A further roller is supported within the frame parallel to and spaced above the rearwardmost of the first set of rollers, these comprising a second set of rollers. A second series of belts are supported between the rollers of the second set for generally vertically inclined travel in response to rotation of the rollers. The belts of this second series are also parallel and spaced apart and alternate with the belts of the first series in the spaces between the belts of that series. This second series of belts directs the leading edge of a carpet runner upwardly.

A plurality of pivotally supported concave downwardly facing fingers extend forwardly in the spaces between the vertically traveling belts to engage the leading edge of a carpet runner to form it into the beginning of a roll. The fingers are spring biased to maintain pressure on the periphery of the carpet roll being formed to insure that the runner is rolled up relatively tightly into a dense compact roll for ease of handling and storage.

Vertically reciprocable stop means are provided adjacent the lowermost of said first pair of rollers. Means are provided whereby the downwardly facing concave fingers are released when the carpet runner is completely rolled and the stop means are reciprocated upwardly to retain the rolled carpet, released by the concave fingers to roll down the first inclined set of belts, for easy removal from the machine. Container means are provided for collecting any residual sand or grit adhering to the laundered carpet runner.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
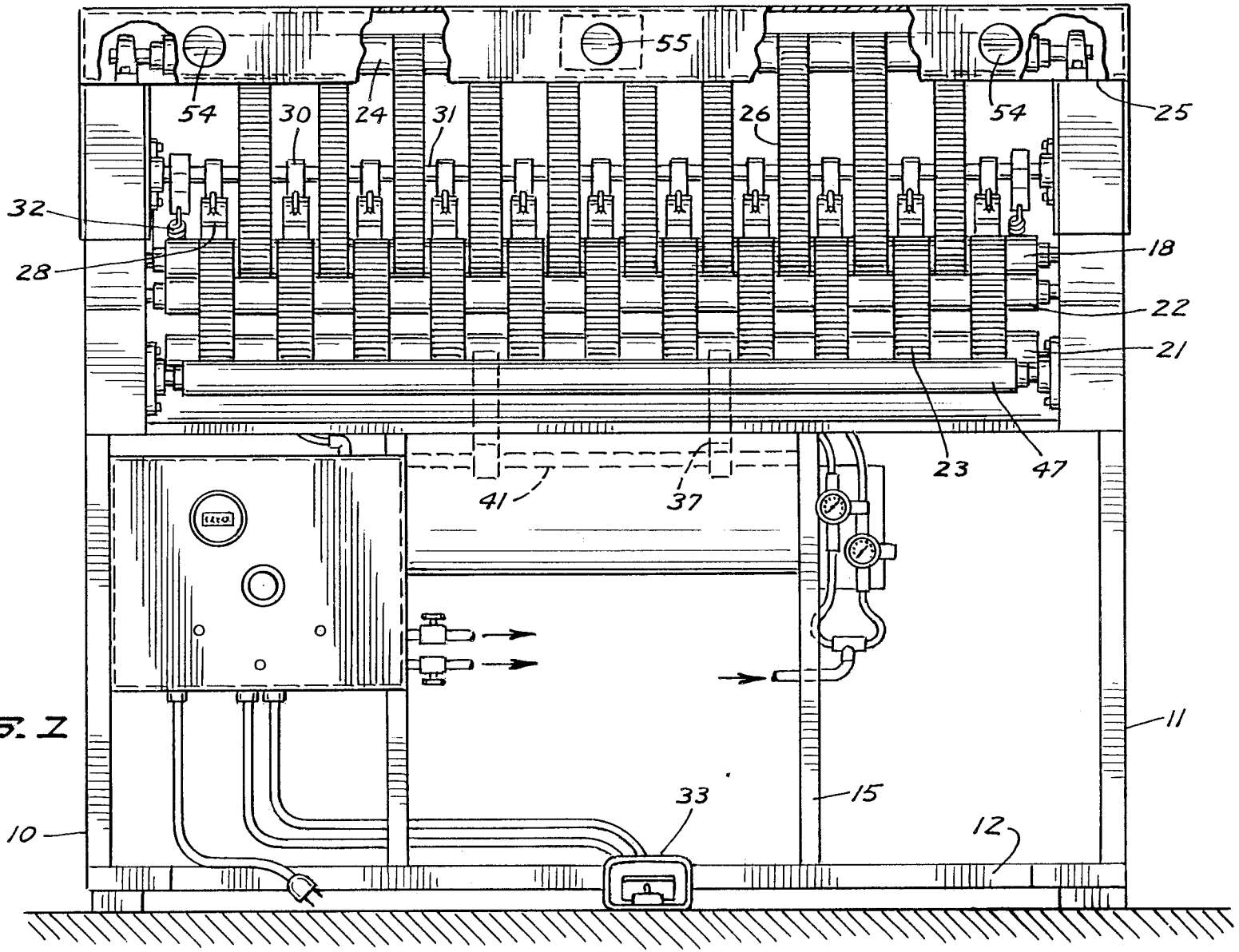
FIG. 1 is a front elevation of the carpet rolling machine according to the present invention, shown partly broken away and in section to reveal interior structure.

Referring now to the drawings, the carpet rolling machine is partially enclosed within a frame housing including left and right hand spaced apart vertical side wall supports 10 and 11, respectively, supported from a rectangular base 12 and in turn carrying a horizontal intermediate support comprised in part of a plurality of spaced apart transverse beams 13 and longitudinal beams 14. Longitudinal members 14 are supported adjacent their forward ends by vertical members 15. Base 12 is intended to rest on the laundry floor, preferably supported on casters for movement as needed.

The vertical side wall supports 10 and 11 each includes an upwardly inclined longitudinally extending side wall member 16 supported at its rearward end by a transverse beam 17. Longitudinal members 16 are disposed at an angle from about 10° to 20° from horizontal, preferably about 15°. A rearward transverse drive roller 18 is journaled for rotation in a pair of bearing blocks mounted on upwardly inclined longitudinal members 16. The shaft of roller 18 at one end is fitted with a gear or pulley connected by means of a drive chain or belt 19 to a further gear or pulley on the shaft of an electric motor 20.

A forward transverse roller 21 is journaled in a pair of bearing blocks supported on inclined longitudinal member 16 of the frame side members. Preferably a further intermediate transverse idler roller 22 is journaled for rotation in a pair of bearing blocks also mounted on inclined members 16. Rollers 18, 20 and 21 are of the same diameter. They are parallel to each other and disposed with their axes lying generally in an upwardly inclined plane, and together constitute a first set of rollers.

A first series of a plurality of identical parallel spaced apart carpet transporting belts 23 extend between rollers 18 and 21, passing over roller 22. The top surfaces of belts 23 define an upwardly inclined plane disposed at an angle of about 10° to 20° from horizontal, preferably about 15°.

A horizontal top support frame and housing overlies the rearward end of the intermediate frame support. Transverse horizontal roller 24 is journaled for rotation in a pair of bearing blocks supported by frame members 25 comprising part of the top support frame. Roller 24 is spaced above roller 18 and is parallel thereto. The axes of rollers 18 and 24 lie in a generally vertical plane. Preferably roller 24 is located slightly forward of roller 18 such that the plane formed by their axes inclines rearwardly from the plane formed by the axes of rollers 18, 21 and 22 by about 5° to 10°. Rollers 18 and 24 together comprise a second set of rollers.

A second series of identical parallel spaced apart carpet transporting belts 26 alternate with and lie between belts 23 of the first series. All of the belts are taut. Belts 23 and 26 are both driven by drive roller 18. The outer surfaces of all of the belts are preferably provided with a roughened surface for better engagement with carpet runners.

Figure 2:
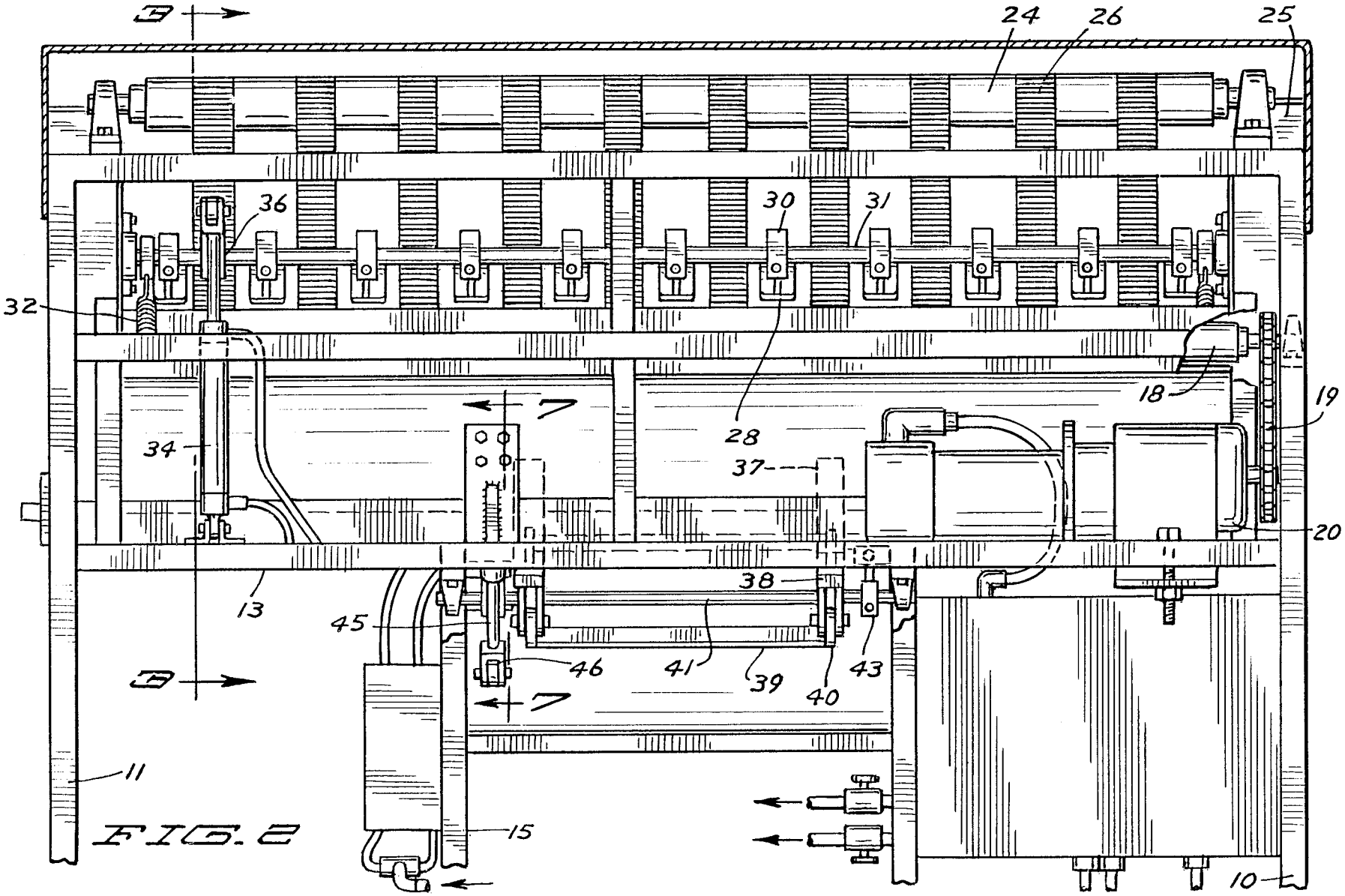
FIG. 2 is a rear elevation thereof, on a slightly enlarged scale, shown partly broken away and in section to reveal interior structure.
Figure 3:
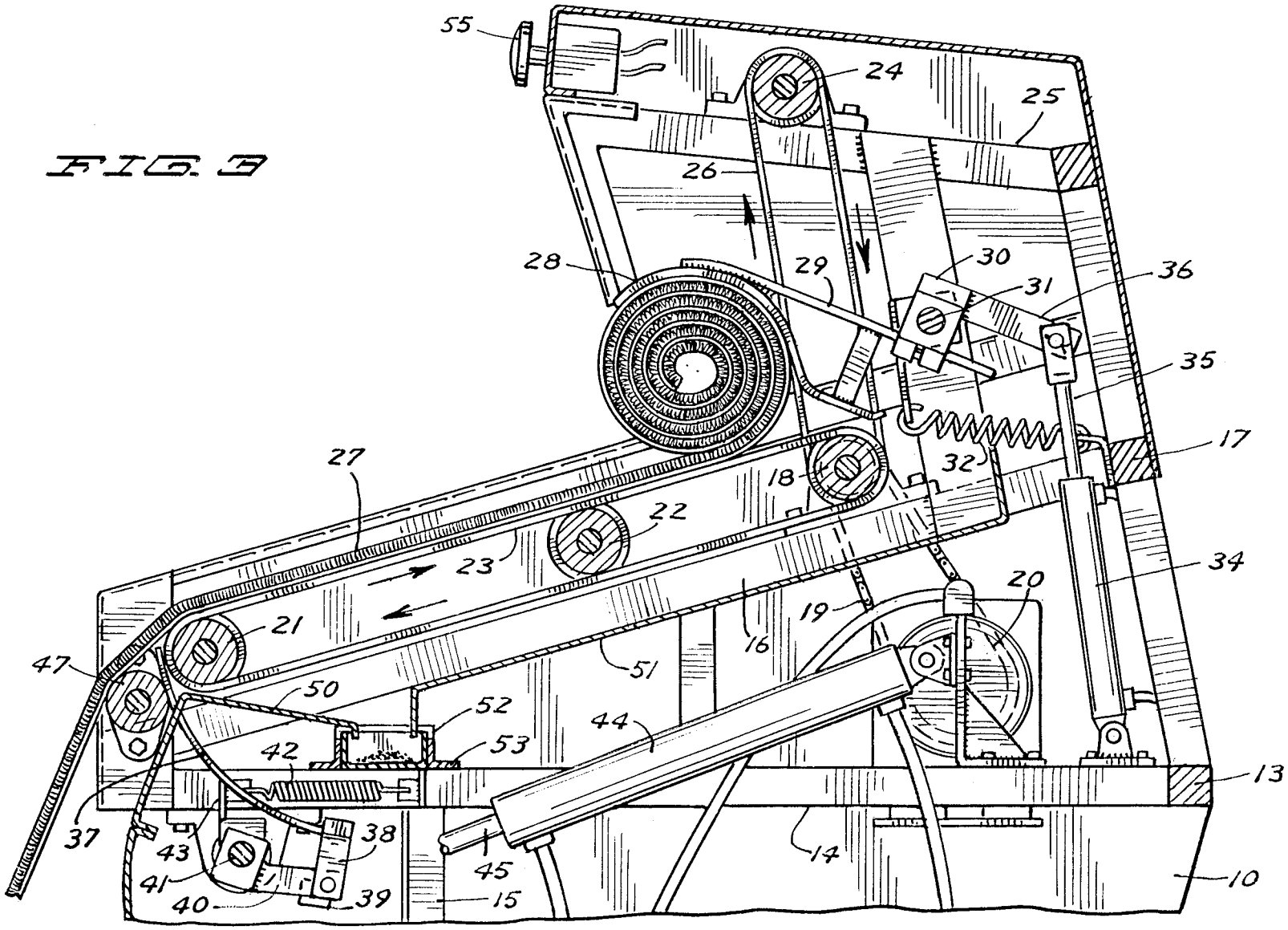
FIG. 3 is a fragmentary right side elevation on an enlarged scale and in section along the line 3—3 of FIG. 2 and in the direction of the arrows, showing the parts in position for rolling a carpet runner.
Figure 4:
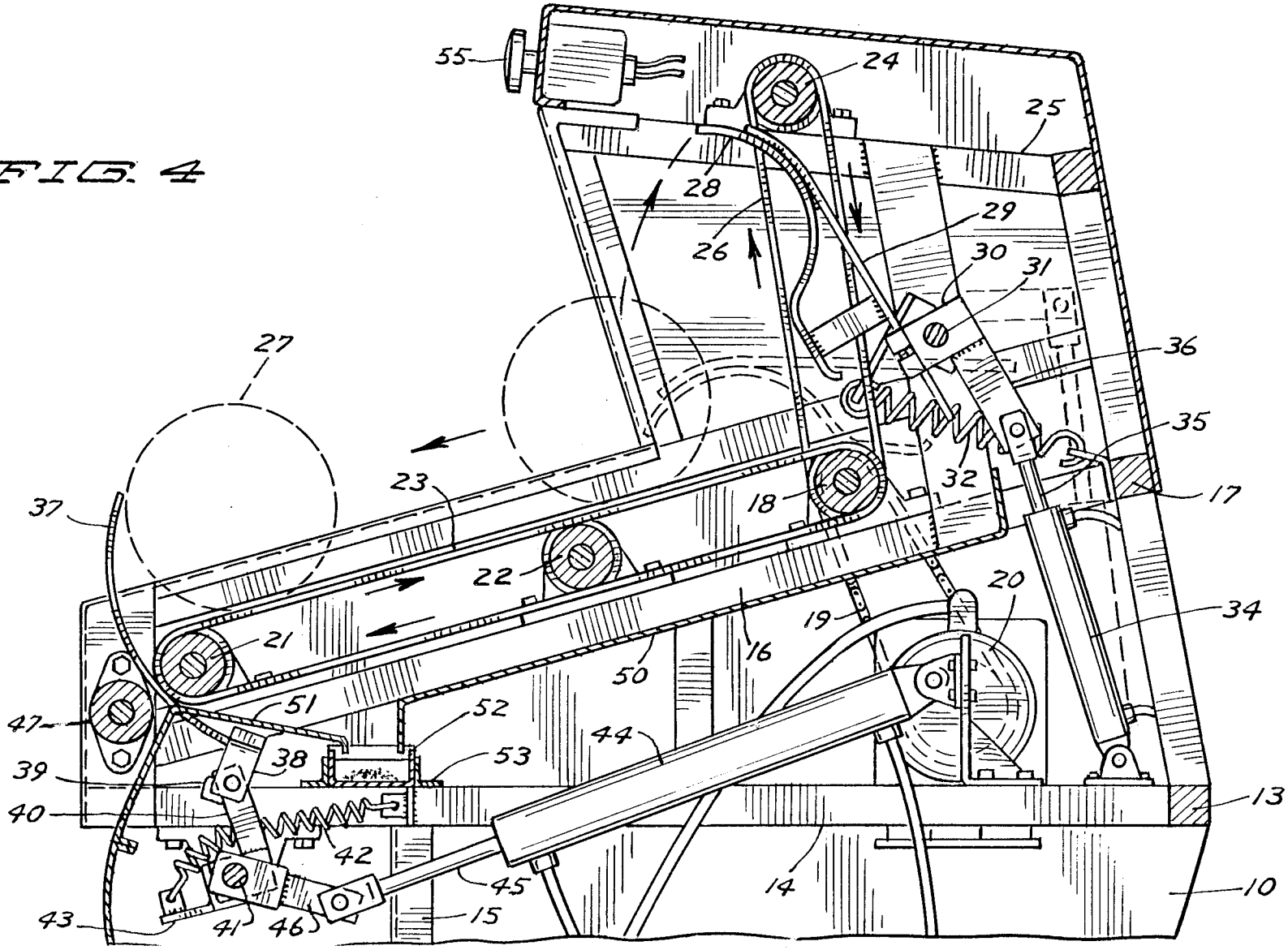
FIG. 4 is a similar side elevation showing the position of parts upon completion of the carpet rolling operation.
Figure 5:
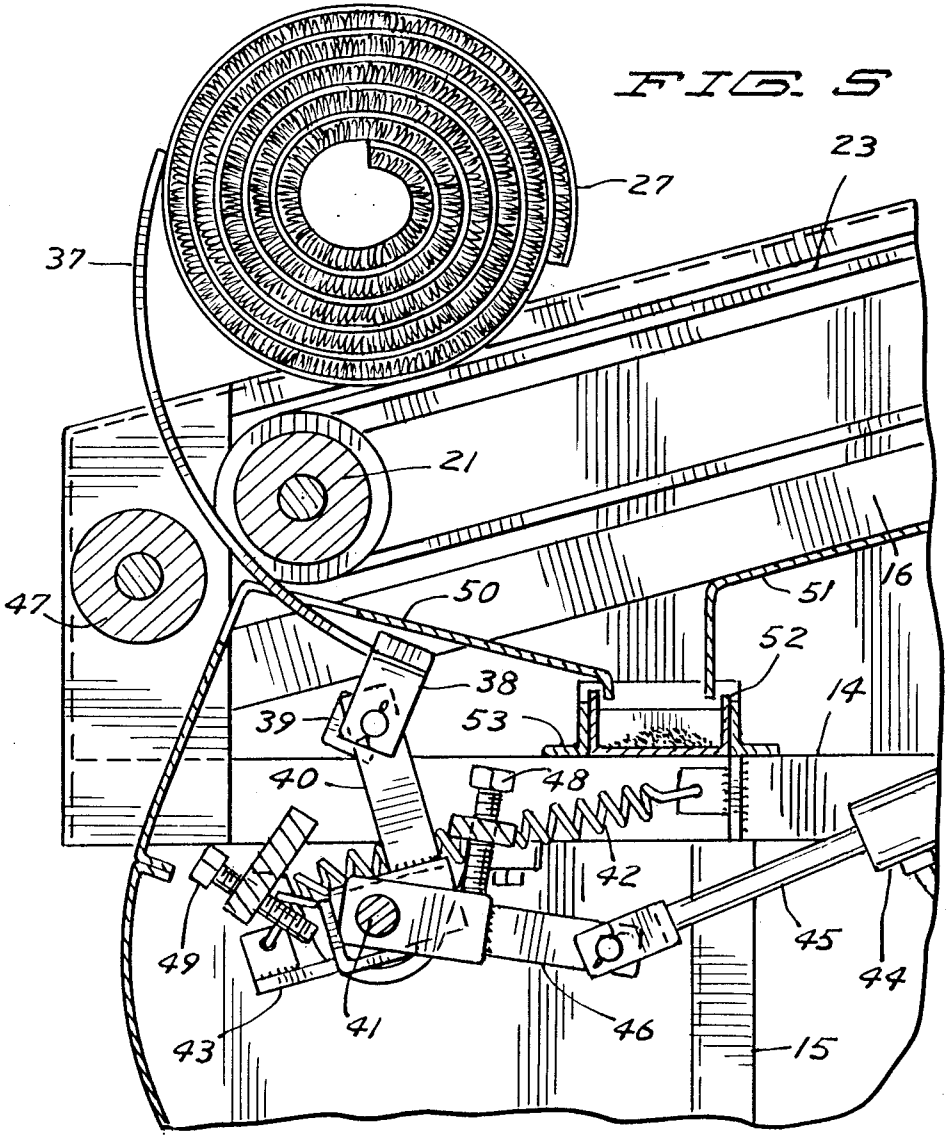
FIG. 5 is a fragmentary right side elevation on a further enlarged scale and in section showing the stop means in extended operative position.
Figure 6:
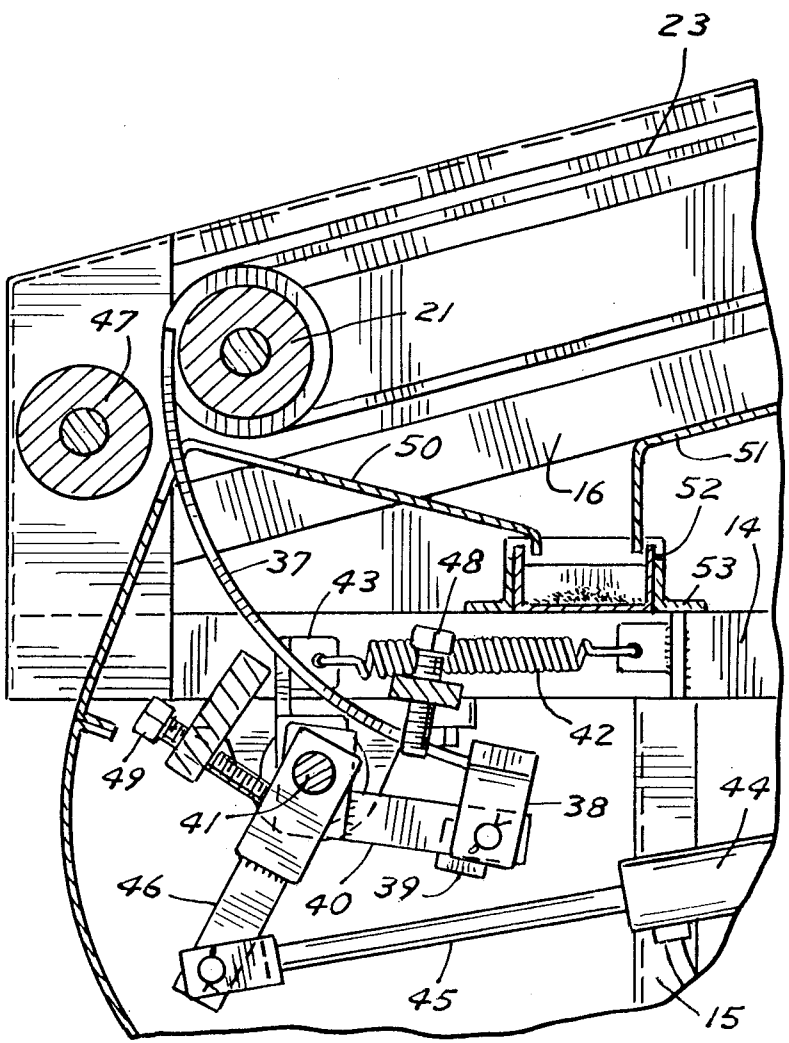
FIG. 6 is a similar fragmentary side elevation showing the stop means in retracted non-operative position.

As best seen by reference to FIGS. 3 and 4, in order to start the formation of a carpet roll, as the leading edge of carpet runner 27 is carried upwardly by belts 26, it engages a plurality of concave downwardly facing fingers 28 which reverse the direction of travel of the carpet runner and directs the leading edge forwardly and downwardly. As seen in FIGS. 1 and 2, each finger assembly is located immediately above an upwardly inclined belt 23 and extends forwardly through the spaces between vertical belts 26.

Each finger 28 is supported from a cantilevered arm 29 whose opposite end is supported in a bracket 30 fixedly secured to horizontal transverse shaft 31. Shaft 31 in turn is supported for limited pivotal rotation in a pair of bearing blocks supported by the side frame members. The entire finger assembly is spring biased on its pivot shaft 31 by coil springs 32 so as to exert constant pressure on the carpet runner 27 as it is being rolled, as best seen in FIG. 3. Fingers 28 are preferably made from or coated with polytetrafluoroethylene polymer, such as is sold under the trademark Teflon.

Upon completion of the formation of a carpet roll, as best seen by comparison of FIGS. 3 and 4, movement of the transport belts 23 and 26 is stopped, as for example, by lifting of the foot from switch 33 to shut off motor 20. At the same time, fingers 28 are released from the carpet roll either manually or automatically by regulation of the flow of air under pressure to cylinder 34 which is pivotally secured to the frame at one end and whose piston 35 is pivotally connected to a crank arm 36 fixed to shaft 31. When the carpet roll is released by fingers 28, it is free to roll down the inclined surface defined by the upper flight of belts 23, which are now stopped.

To prevent the carpet roll from rolling off the forward edge of the carpet rolling machine, reciprocable arms 37 are caused to move upwardly adjacent to but forward of roller 21 with their ends extending upward from the top surface of belts 23 sufficiently far to hold the carpet roll. Arms 37 are flat and arcuate and preferably two in number. At their lowermost ends, arms 37 are fixedly secured to the top closed ends of yokes 38 whose bottommost ends are fixedly secured to a transverse bar 39 so that the stop arm assembly moves as a unit. Yokes 39 each embrace and are pivotally secured to crank arms 40 which are fixedly secured to transverse horizontal shaft 41 for limited rotational movement therewith. Shaft 41 is journaled at its opposite ends for limited rotational movement in bearing blocks secured to the under side of the forwardmost of transverse beams 13.

Upon rotation of shaft 41 through about a quarter turn, the stop arm assembly comprised of arms 37, yokes 38 and cross bar 39 reciprocate to extend upwardly in an arcuate path, or to be retracted. The stop arms 37 are guided in their movement by bearing against the forward edge of roller 21, preferably in grooves provided in the surface of the roller. The stop arm assembly ordinarily is maintained in the retracted position by virtue of coil spring 42, one end of which is secured to the machine frame and the opposite end of which is connected to a further crank arm 43 fixedly secured to shaft 41 for limited rotation therewith.

The stop arms 37 may be caused to extend automatically upon shutting off of motor 20 by virtue of air being supplied to cylinder 44, one end of which is pivotally attached to the machine frame and whose piston 45 is pivotally attached to a further crank arm 46 fixedly secured to shaft 41 to cause limited rotational movement thereof. Actuation of cylinder 44 causes partial rotation of shaft 41 against the tension of spring 42 to cause extension of the stop arm assembly into the path of a completed carpet roll to prevent it from rolling off the front of the machine. From its stopped position at the bottom of the inclined belt surface, the rolled carpet is readily removed, to be replaced by a further carpet runner. The stop arms may be retracted by manual operation of the control system, or automatically after a short time delay sufficient to permit removal of the rolled carpet.

Release of air from cylinder 34 coupled with the tension exerted by coil spring 32 causes partial rotation of shaft 31 and return of the entire assembly of fingers 28 into their downward position for rolling the next length of carpet runner.

An idler roller 47 is desirably journaled in the front edge of the frame, spaced forwardly and slightly downwardly from roller 21, sufficient to permit passage of the stop arms. Roller 47 facilitates initial placement of the leading edge of a carpet runner to be rolled for engagement by the transport belts 23.

Figure 7:
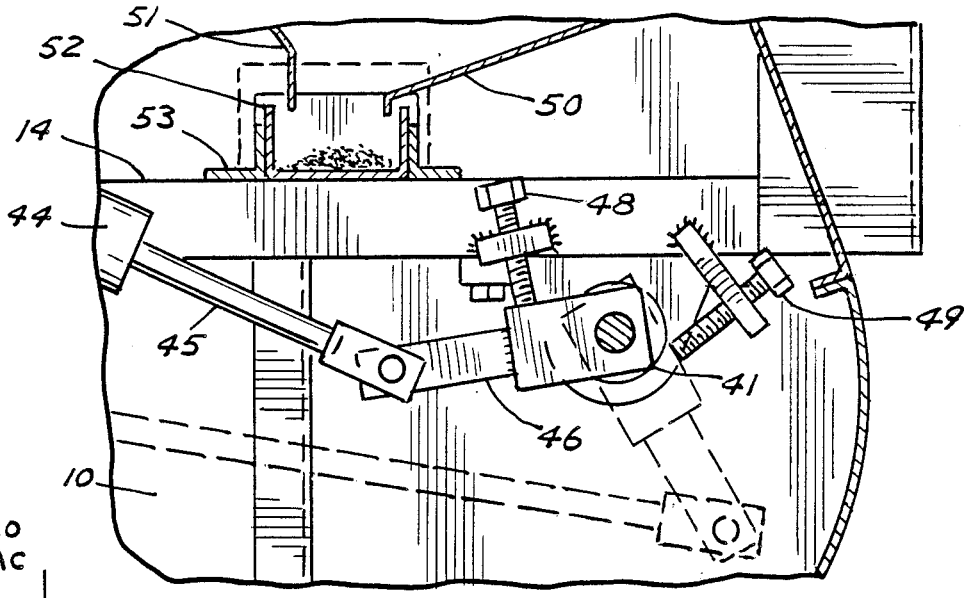
FIG. 7 is a similar fragmentary side elevation in section along the line 7—7 of FIG. 2 and in the direction of the arrows showing details of the mechanism for actuating the stop means and limiting its movement.

As best seen in FIG. 7, stops in the form of screws 48 and 49 limit the extent of movement of crank arm 46, limiting the amount of rotation of shaft 41 and the extent of extension and retraction of the stop arm assembly.

Experience has shown that some sand and other grit may remain in the carpet runners after laundering and drying. To prevent this grit from contaminating the machine, collection means are provided. A pair of sheet metal deflector plates 50 and 51 are positioned under transport belts 23 and their supporting rollers 18, 21 and 22. The deflector plates extend the entire width of the machine between the side frame members. The rearward edge of deflector plate 50 and the forward edge of deflector plate 51 are spaced apart to define a transverse opening. The deflector plates are sloped downwardly toward this opening to define a trough-like structure. A removable collection box 52, preferably in the form of a drawer, is disposed under the opening between the ends of the deflector plates, held in place by a pair of parallel spaced apart guide angle members 53 supported between the side frame members. Whatever grit may adhere to the carpet runner may be jarred loose to fall through the transport belts 23 onto the deflector plates to migrate down the plates to the discharge opening and into the collection container drawer 52. This drawer is removed from time to time and emptied as necessary. The slight vibration induced during normal operation of the machine facilitates the travel of the grit particles down the deflector plates.

Figure 8:
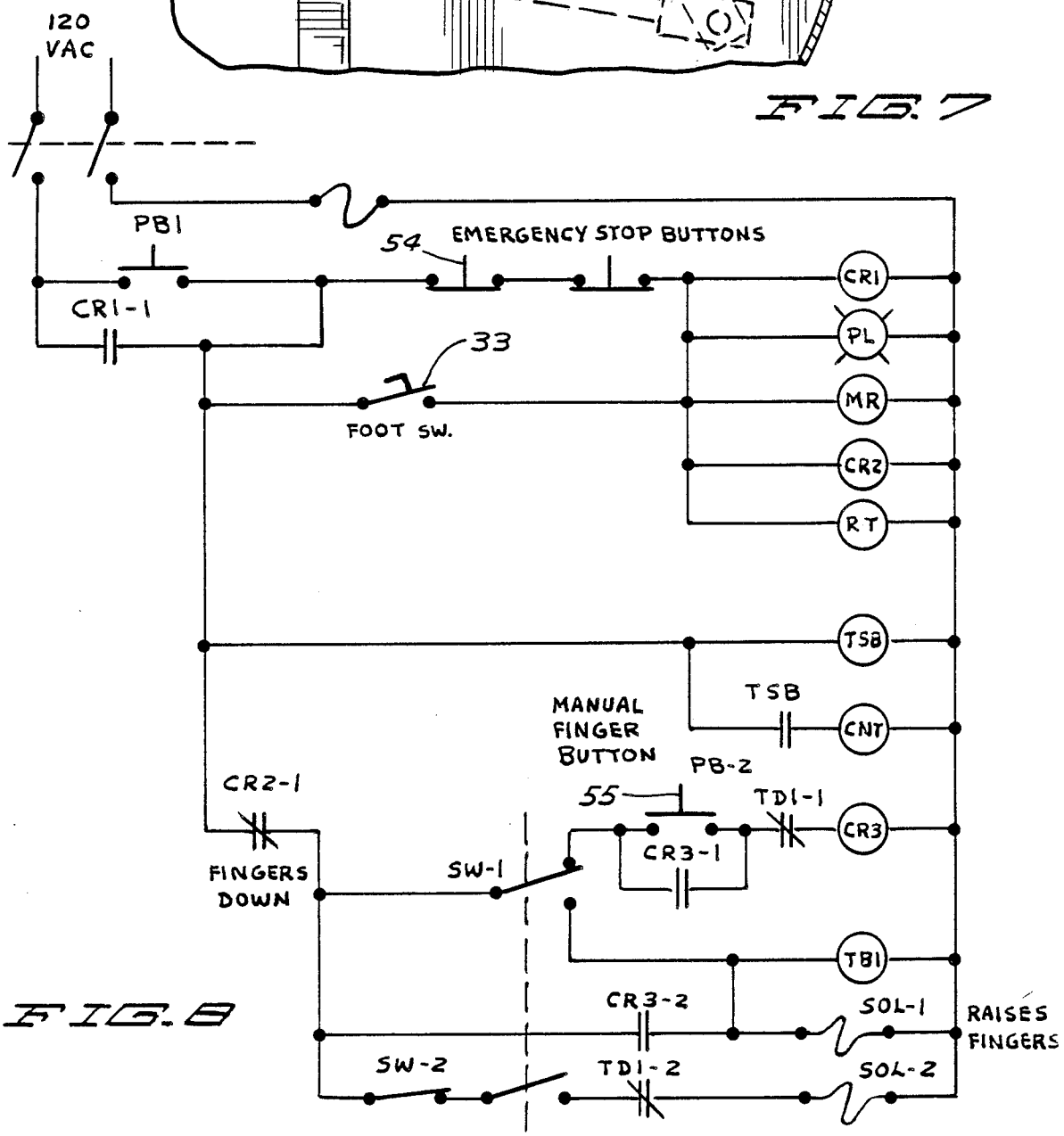
FIG. 8 is a schematic diagram of the operating control means.

Referring to FIG. 8, there is shown one exemplary control system for the operation of the carpet rolling machine. The control circuit is energized by an on-off switch PB-1 which energizes CR-1. The circuit may be deenergized by one of emergency stop buttons 54 (PB-3 or PB-4). Pressing the foot pedal 33 closes microswitch MS which energizes the motor relay MR and CR2. The run time meter RT will run as long as the foot pedal is down. For automatic operation, CR2-1 contact opens, deenergizing the finger solenoid SOL-1 which allows the fingers to lower. When the foot pedal is lifted, the motor stops, solenoid SOL-1 raises the fingers, timer TD-1 energizes and begins to time up, and providing that switch SW-2 is closed, solenoid SOL-2 raises the roll stop arms 37. The roll stop assembly remains up until TD-I has timed out. In manual operation, the roll stop is not available. Fingers 28 are down until finger button 55 (PB-2) is pressed. CR-3 energizes and seals through contact CR3-1. CR3-2 energizes solenoid SOL-1 which lifts the fingers and energizes timer TD-1 which begins to time up. At the end of the delay, TD-1-1 opens, deenergizing CR-3 and in turn solenoid SOL-1, which allows the fingers to return to their lowered position.

In the operation of the machine, the finger assembly is initially in the lowermost position, as shown in FIG. 4. With the control circuit energized, the leading edge of a length of carpet runner is lined up with roller 21, facilitated by idler 47. The machine is operated by actuation of the foot pedal 33 and the carpet runner is quickly carried by belts 23 and 26 and rolled into a tight compact roll, as seen in FIG. 3. When in the automatic mode, when the foot pedal is lifted the motor stops, the finger assembly is raised, and the roll stop assembly is raised to catch the carpet roll as it rolls down the inclined belt surface, as seen in FIG. 4. The carpet roll is lifted off the machine and the roll stop assembly automatically retracts and the finger assembly is automatically lowered. When in the manual mode, the motor driving the transport belts is turned on by depressing the foot pedal. When the carpet is rolled the fingers are raised by depressing button 55 and the released carpet roll is caught and removed as it reaches the forward end of the machine.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A machine for rolling carpet runners, which machine includes a front and a back and comprises:

(A) a frame;

(B) a first set of at least a pair of spaced apart parallel rollers supported within said frame for rotation in an upwardly inclined plane sloping from the front of the machine;

(C) drive means connected to one of said rollers;

(D) a further roller supported within said frame parallel to and spaced above the rearwardmost of said first set of rollers;

(E) a first series of a plurality of endless parallel spaced apart belts supported on said first set of rollers for upward sloping longitudinal movement in response to rotation of the rollers;

(F) a second series of a plurality of endless parallel spaced apart belts supported between the rearwardmost of said first set of rollers and said further roller for generally vertical travel in response to rotation of the rollers, the belts of said second series alternating with the belts of said first series in the spaces between the belts of the first series;

(G) an assembly of a plurality of concave downwardly facing fingers pivotally supported and extending forwardly in the spaces between said second series of belts and spaced above the first series of belts;

(H) reciprocable stop means supported in said frame closely spaced forwardly of the forwardmost of said first set of rollers for extension higher than the top surface of said first series of endless belts and retraction below said top surface and comprising:

(1) at least a pair of arcuate arms fixed at their lowermost ends to a common transversely extending bar in a stop arm assembly for movement together;

(2) a transversely extending shaft journaled in said frame for limited rotation;

(3) a first crank arm fixedly secured at one end to said shaft for limited rotation therewith and pivotally attached at the other end to said stop arm assembly, and (4) means for partially rotating said shaft; and (I) means for controlling operation of said drive means, and finger assembly and stop means.

2. A machine according to claim 1 wherein:

(A) said further roller is located slightly forward of the rearwardmost of said first set of rollers, and (B) the axes of said further roller and the rearwardmost of said first set of rollers lie in a generally vertical plane inclined rearwardly from said further roller by about 5° to 10°.

3. A machine according to claim 1 wherein said drive means is connected to the rearwardmost of said first set of rollers.

4. A machine according to claim 3 wherein an idler roller is disposed between and parallel to said forwardmost roller and rearwardmost drive roller of said first set of rollers, the axes of said rollers lying generally in an upwardly inclined common plane.

5. A machine according to claim 1 wherein a further idler roller is journaled for rotation in the frame spaced from but closely adjacent to the forwardmost of said first set of rollers, slightly below and forward of, and parallel thereto, said stop means extending between said spaced but closely adjacent rollers.

6. A machine according to claim 1 wherein said means for partially rotating said shaft comprises:

(A) a second crank arm fixedly secured at one end to said shaft;

(B) A fluid operated cylinder pivotally secured to said frame in longitudinal alignment with said second crank arm, and (C) A pivotal connection between the piston of said cylinder and the opposite end of said second crank arm.

7. A machine according to claim 6 wherein spring biasing means extend between said frame and said stop arm assembly to normally maintain said stop arms in retracted position.

8. A machine according to claim 1 wherein said upwardly inclined plane slopes upwardly at an angle of from about 10° to 20° from horizontal.

9. A machine for rolling carpet runners, which machine includes a front and a back and comprises:

(A) a frame;

(B) a first set of at least a pair of spaced apart parallel rollers supported within said frame for rotation in an upwardly inclined plane sloping from the front of the machine at an angle of about 10° to 20° from horizontal;

(C) drive means connected to one of said rollers;

(D) a further roller supported within said frame parallel to and spaced above the rearwardmost of said first set of rollers;

(E) a first series of a plurality of endless parallel spaced apart belts supported on said first set of rollers for upward sloping longitudinal movement in response to rotation of the rollers;

(F) a second series of a plurality of endless parallel spaced apart belts supported between the rearwardmost of said first set of rollers and said further roller for generally vertical travel in response to rotation of the rollers, the belts of said second series alternating with the belts of said first series in the spaces between the belts of the first series;

(G) an assembly of a plurality of concave downwardly facing fingers pivotally supported and extending forwardly in the spaces between said second series of belts and spaced above the first series of belts;

(H) reciprocable stop means supported in said frame closely spaced forwardly of the forwardmost of said first set of rollers for extension higher than the top surface of said first series of endless belts and retraction below said top surface, said stop means comprising:

(1) at least a pair of arcuate arms fixed at their lowermost ends to a common transversely extending bar in a stop arm assembly for movement together, (2) a transversely extending shaft journaled in said frame for limited rotation, (3) a first crank arm fixedly secured at one end to said shaft for limited rotation therewith and pivotally attached at the other end to said stop arm assembly, and (4) means for partially rotating said shaft, and (I) means for controlling operation of said drive means, said finger assembly and stop means.

10. A machine according to claim 9 wherein said means for partially rotating said shaft comprises:

(A) a second crank arm fixedly secured at one end of said shaft;

(B) a fluid operated cylinder pivotally secured to said frame in longitudinal alignment with said second crank arm, and (C) a pivotal connection between the piston of said cylinder and the opposite end of said second crank arm.

11. A machine according to claim 10 wherein spring biasing means extend between said frame and said stop arm assembly to normally maintain said stop arms in retracted position.

12. A machine according to claim 9 wherein:

(A) said further roller is located slightly forward of the rearwardmost of said first set of rollers, and (B) the axes of said further roller and the rearwardmost of said first set of rollers lie in a generally vertical plane inclined rearwardly from said further roller by about 5° to 10°.

13. A machine according to claim 9 wherein said collection means are provided, comprising:

(A) a first deflector plate underlying said first series of belts and sloping downwardly from its forwardmost to rearwardmost edge;

(B) a second deflector plate underlying said first series of belts and sloping downwardly from its rearwardmost to forwardmost edge; p1 (C) a transverse discharge opening between the rearwardmost edge of the first deflector plate and forwardmost edge of the second deflector plate; and (D) a removable grit collector container underlying said discharge opening.

14. A machine for rolling carpet runners, which machine includes a front and a back and comprises: a frame, a first set of spaced apart parallel horizontal rollers supported between the sides of said frame, drive means for said rollers, a further roller parallel to and spaced above the rearwardmost of said first set of rollers, a first series of endless parallel spaced apart belts supported by said first set of rollers for longitudinal movement, a second series of endless parallel spaced apart belts supported between the rearwardmost of said first set of rollers and said further roller for generally vertical travel, the belts of said second series alternating with the belts of said first series in the spacers between the belts of the first series, an assembly of concave downwardly facing fingers pivotally supported and extending forwardly in the spaces between said second series of belts and spaced above the first series of belts, and means for controlling operation of said drive means, said machine characterized by:

(A) said first set of rollers being supported within said frame for rotation in an upwardly inclined plane sloping from the front of the machine; and (B) reciprocable stop means supported in said frame closely spaced forwardly of the forwardmost of said first set of rollers for extension higher than the top surface of said first series of endless belts and retraction below said top surface, said stop means comprising:

(1) at least a pair of arcuate arms fixed at their lowermost ends to a common transversely extending bar in a stop arm assembly for movement together;

(2) a transversely extending shaft journaled in said frame for limited rotation;

(3) a first crank arm fixedly secured at one end to said shaft for limited rotation therewith and pivotally attached at the other end to said stop arm assembly;

(4) a second crank arm fixedly secured at one end to said shaft;

(5) a fluid operated cylinder pivotally secured to said frame in longitudinal alignment with said second crank arm;

(6) a pivotal connection between the piston of said cylinder and the opposite end of said second crank arm; and (7) spring biasing means extending between said frame and said stop arm assembly to normally maintain said stop arm in retracted position.

15. A machine according to claim 14 further characterized in that said upwardly inclined plane slopes upwardly at an angle of from about 10° to 20° from horizontal.

16. A machine according to claim 14 further characterized in that:

(A) said further roller is located slightly forward of the rearwardmost of said first set of rollers, and (B) the axes of said further roller and the rearwardmost of said first set of rollers lie in a generally vertical plane inclined rearwardly from said further roller by about 5° to 10°.

17. A machine according to claim 14 further characterized in that grit collection means are provided, comprising:

(A) a first deflector plate underlying said first series of belts and sloping downwardly from its forwardmost to rearwardmost edge;

(B) a second deflector plate underlying said first series of belts and sloping downwardly from its rearwardmost to a forwardmost edge;

(C) a transverse discharge opening between the rearwardmost edge of the first deflector plate and forwardmost edge of the second deflector plate; and (D) a removable grit collection container underlying said discharge opening.

18. A machine for rolling carpet runners, which machine includes a front and a back and comprises:

(A) a frame;

(B) a first set of at least a pair of spaced apart parallel rollers supported within said frame for rotation in an upwardly inclined plane sloping from the front of the machine;

(C) drive means connected to one of said rollers;

(D) a further roller supported within said frame parallel to and spaced above the rearwardmost of said first set of rollers;

(E) a first series of a plurality of endless parallel spaced apart belts supported on said first set of rollers for upward sloping longitudinal movement in response to rotation of the rollers;

(F) a second series of a plurality of endless parallel spaced apart belts supported between the rearwardmost of said first set of rollers and said further roller for generally vertical travel in response to rotation of the rollers, the belts of said second series alternating with the belts of said first series in the spaces between the belts of the first series;

(G) an assembly of a plurality of concave downwardly facing fingers pivotally supported and extending forwardly in the spaces between said second series of belts and spaced above the first series of belts;

(H) reciprocable stop means supported in said frame closely spaced forwardly of the forwardmost of said first set of rollers for extension higher than the top surface of said first series of endless belts and retraction below said top surface;

(I) grit collection means comprising:

(1) a first deflector plate underlying said first series of belts and sloping downwardly from its forwardmost to rearwardmost edge;

(2) a second deflector plate underlying said first series of belts and sloping downwardly from its rearwardmost to forwardmost edge;

(3) a transverse discharge opening between the rearwardmost edge of the first deflector plate and forwardmost edge of the second deflector plate; and (4) a removable grit collector container underlying said discharge opening; and (J) means for controlling operation of said drive means, and finger assembly and stop means.

* * * * *

UNITED STATES PATENT AND TRADEMARK OFFICE

CERTIFICATE OF CORRECTION

PATENT NO. : 4,973,010

DATED : November 27, 1990

INVENTOR(S) : ROBERT W. BROWN

It is certified that error appears in the above-identified patent and that said Letters Patent is hereby corrected as shown below:

Title page:

Abstract, line 4, "interesting" should be -- interacting ---.

Column 3, line 9, "20 and 21" should be -- 21 and 22 --.

Column 4, line 15, "39" should be -- 38 --.

Column 8, line 29, "pl" should be deleted and "(C)" should begin a new subparagraph.

Column 10, line 41, "collector" should be -- collection --.

Signed and Sealed this

Sixth Day of August, 1991

*Attest:*

*Attesting Officer*

HARRY F. MANBECK, JR.

*Commissioner of Patents and Trademarks*